United States Patent [19]

Chan et al.

[11] Patent Number: 4,779,428

[45] Date of Patent: Oct. 25, 1988

[54] JOULE THOMSON REFRIGERATOR

[75] Inventors: Chung K. Chan, Los Angeles; John R. Gatewood, La Crescenta, both of Calif.

[73] Assignee: United States of America as represented by the Administrator, National Aeronautics and Space Administration, Washington, D.C.

[21] Appl. No.: 105,847

[22] Filed: Oct. 8, 1987

[51] Int. Cl.[4] ..... F25B 7/00

[52] U.S. Cl. ..... 62/467; 62/514 JT

[58] Field of Search ..... 65/467, 500, 514 R, 65/514 JT

[56] References Cited

U.S. PATENT DOCUMENTS

| | | | |
|---|---|---|---|
| 3,413,819 | 12/1968 | Hansen | 62/514 JT |
| 3,442,093 | 5/1969 | Rietdijk | 62/500 |
| 3,818,720 | 6/1974 | Campbell | 62/514 JT |
| 4,080,802 | 3/1978 | Annable | 62/514 JT |
| 4,111,002 | 9/1978 | Van Mal et al. | 62/467 |
| 4,126,017 | 11/1978 | Bytniewski et al. | 62/514 JT |
| 4,366,680 | 1/1983 | Tward | 62/514 R |
| 4,498,313 | 2/1985 | Hosoyama et al. | 62/514 R |
| 4,612,782 | 9/1986 | Urch | 62/500 |
| 4,641,499 | 2/1987 | Jones | 62/48 |
| 4,671,080 | 6/1987 | Gross | 62/467 |

*Primary Examiner*—Ronald C. Capossela

*Attorney, Agent, or Firm*—Paul F. McCaul; Thomas H. Jones; John R. Manning

[57] ABSTRACT

A bi-directional Joule Thomson refrigerator is described, which is of simple construction at the cold end of the refrigerator. Compressed gas flowing in either direction through the Joule Thomson expander valve and becoming liquid, is captured in a container in direct continuous contact with the heat load. The Joule Thomson valve is responsive to the temperature of the working fluid near the valve, to vary the flow resistance through the valve so as to maintain a generally constant mass flow between the time that the refrigerator is first turned on and the fluid is warm, and the time when the refrigerator is near its coldest temperature and the fluid is cold. The valve is operated by differences in thermal coefficients of expansion of materials to squeeze and release a small tube which acts as the expander valve.

5 Claims, 1 Drawing Sheet

FIG. 1
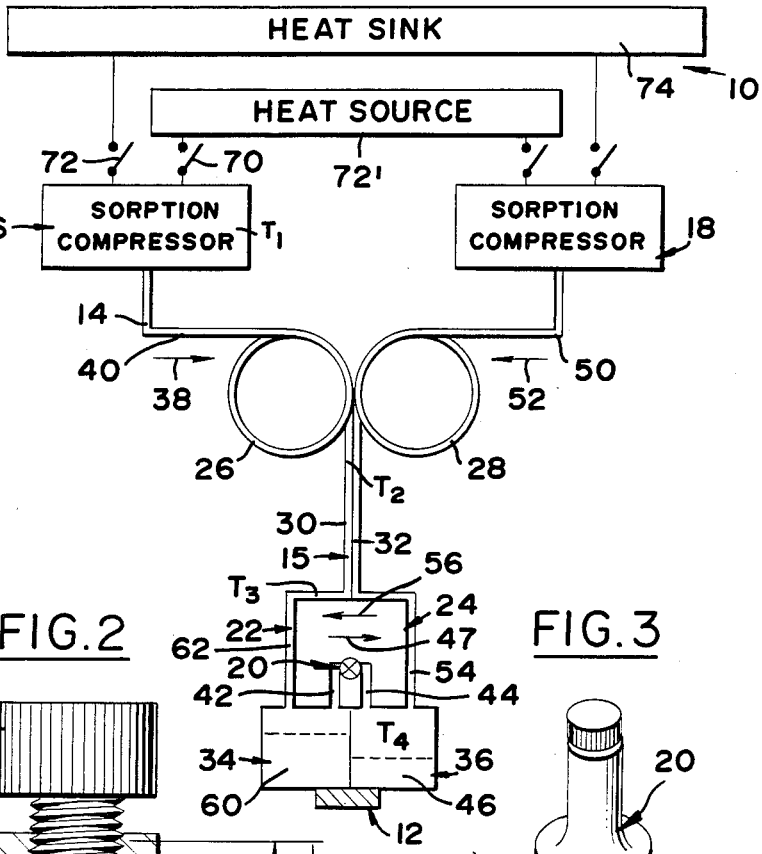
FIG. 2
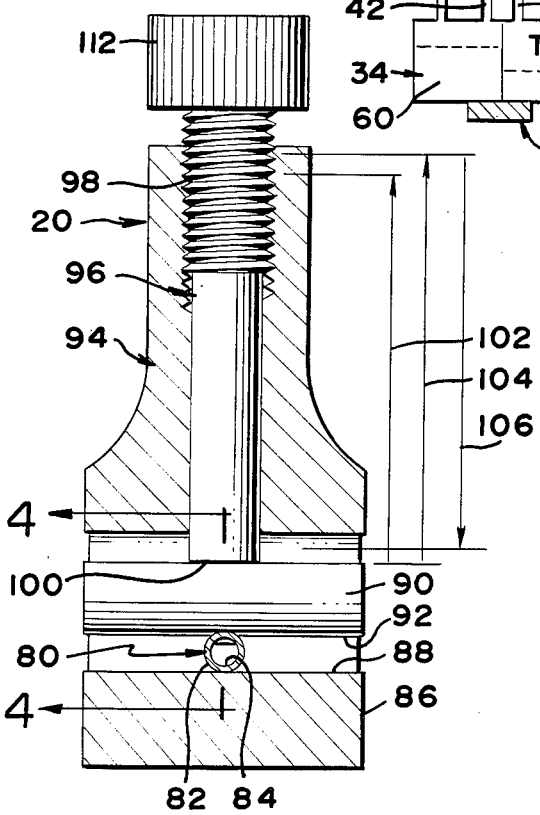
FIG. 3
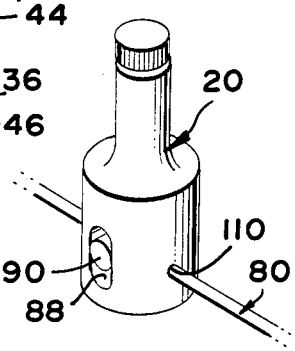
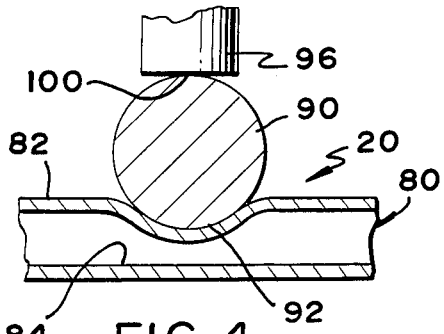
FIG. 4

JOULE THOMSON REFRIGERATOR

ORIGIN OF THE INVENTION

The invention described herein was made in the performance of work under a NASA contract, and is subject to the provisions of Public Law 96-517 (35 USC 202) in which the Contractor has elected not to retain title.

BACKGROUND OF THE INVENTION

A simple cryogenic refrigerator can be provided by a pair of compressors that move the working fluid cyclically in opposite directions through a Joule Thomson expansion valve. U.S. Pat. No. 4,366,680 by Tward describes a system of this type, wherein a gaseous working fluid at a first temperature moves through stages of progressive cooling. These stages include a precooler that cools the fluid to a second lower temperature, a heat exchanger that cools the fluid to a third lower temperature, an expansion chamber that cools the fluid to a fourth lower temperature, and a Joule Thomson expansion valve that cools the fluid to a lower fifth temperature. Fluid on the downstream side of the valve is coupled through a heat switch to the thermal load that is to be cooled. The fluid continues to a second compressor which initially takes up the fluid and later moves it in a reverse direction through several stages of cooling, until the fluid passes in the reverse direction through the expansion valve. Fluid at the new downstream side of the valve is coupled through another heat switch to the thermal load. The use of heat switches operating at very low temperature wastes cooling capacity and adds complexity to the system. A system which avoided the need for heat switches at the coldest temperature, would be of considerable value.

When a Joule Thomson refrigeration system first starts operating, the working fluid is warm, and only after a considerable period of time does the working fluid achieve steady state operation when the fluid achieves a minimum temperature at each location of the system. For almost all working fluids, the density of the fluid increases as it becomes colder. Where the Joule Thomson valve is set for optimum operation at steady state condition when the fluid is cold and dense, the system will operate inefficiently during startup when the fluid is warmer and less dense. For example, common working fluids such as helium may undergo a change in density of 15 to 1 between room temperature and a cryogenic temperature such as 20° K. An expansion valve whose resistance to fluid flow therethrough is optimal for steady state condition is at 20° K., will permit only a very low mass flow rate of fluid therethrough during startup. This greatly increases the period between initial startup of the system and achievement of a desired low temperature. A system which more efficiently operated during startup would be of considerable value.

SUMMARY OF THE INVENTION

In accordance with one embodiment of the present invention, a Joule-Thomson refrigerator is provided whose cold end is relatively simple and efficient. The refrigerator includes a Joule-Thomson valve through which substantially all fluid expansion occurs, with the system perameters set so that some of the gaseous fluid passing through the valve liquefies. A liquid-holding container is positioned to receive the liquid, the container being in continuous thermal contact with the heat load to be cooled. In a bi-directional refrigerator, a pair of liquid containers are located at opposite sides of the valve, and each is directly and continually thermally coupled to the heat load, and both containers are at substantially the same temperature.

The valve provides a resistance to the flow of gaseous working fluid therethrough, with the resistance to flow being variable. A means responsive to the temperature of the liquid, such as a temperature near the location of the valve, controls the resistance of the valve to the passage of fluid therethrough, so as the fluid temperature decreases during startup of the system the resistance increases. The resistance to flow preferrably changes to maintain a more contant mass flow of working fluid than would occur if the resistance to flow remained constant. The valve can include a squeezable tube, and elements of different thermal coefficients of expansion coupled to the valve and that use the differential coefficients of expansion to automatically squeeze and release the tube with changing working fluid temperature.

The novel features of the invention are set forth with particularity in the appended claims. The invention will be best understood from the following description when read in conjunction with the accompanying drawings.

BRIEF DESCRIPTION OF THE DRAWINGS

FIG. 1 is a diagramatic view of a refrigerator constructed in accordance with the present invention.

FIG. 2 is a sectional view of a Joule Thomson valve constructed in accordance with the invention, and useful in the refrigerator of FIG. 1.

FIG. 3 is a perspective view of the valve of FIG. 2.

FIG. 4 is a view taken on the line of 4—4 of FIG. 2, at a time when the valve is partially constricted.

DESCRIPTION OF THE PREFERRED EMBODIMENTS

FIG. 1 illustrates a refrigeration system 10 of the Joule Thomson type for cooling a heat load 12 to a cryogenic temperature. The refrigerator is a bi-directional type wherein a working fluid 14 cyclically flows in opposite directions through a conduit 15 between a pair of compressors 16, 18 by way of a Joule Thomson expansion valve 20. The system is symmetrical, with two symmetrical branches 22, 24, each including a precooler 26, 28, a counterflow heat exchanger 30, 32, and a liquid retention chamber or container 34, 36.

An understanding of the operation can be gained by considering one cycle of operation. Assuming that almost all of the working fluid is in the left compressor 16 at a first temperature $T_1$, the compressor 16 is operated to expel the fluid at a high pressure therefrom. The pressured fluid flows in the direction of the arrow 38 through a tube 40 to the precooler 26 where the fluid is cooled to a second temperature $T_2$ lower than $T_1$. The fluid then flows through the heat exchanger 30 where it undergoes a further reduction of temperature so that it achieves a third temperature $T_3$. The fluid then flows through the valve 20 where its pressure is greatly lowered and where it undergoes an additional drop in temperature to a temperature $T_4$. At the temperatures $T_1$ to $T_3$, the working fluid is gaseous. However, in passing through the valve 20, from a first side 42 to a second side 44, the fluid is sufficiently cooled that some of it liquefies, the liquid fluid appearing at the downstream side of the valve at 44. The liquid retention chamber 36 on the second side 44 of the valve captures the liquid portion 46 of the fluid.

The chamber 36 is in direct and continuous thermal contact with the heat load 12 that is to be cooled. There is continuous evaporation of the liquid 46, although there remains some fluid to maintain the heat load 12 at a constant temperature. A portion of the fluid passing in a first direction 47 through the valve that does not liquefy, as well as gas evaporated from the liquid 46, passes through heat exchanger 32 where its temperature is raised to lower the temperature of fluid in the heat exchanger 30, and passes through the precooler 28 and a tube 50 to the compressor 18. At that time, the compressor 18 is operated to draw in fluid. After most of the fluid has passed from the first compressors 16 through the valve 20 to the second compressor 18, the refrigerator is operated in the reverse direction to begin the second half of the cycle. This is accomplished by operating the right side compressor 18 to compress the gaseous working fluid therein to a high pressure, while the left side compressor 16 is operated to receive working fluid.

During the second half of the cycle, fluid flows in the direction of arrow 52 from the right side compressor 18 through the precooler 28 where the fluid drops in temperature, and then through the heat echanger 32 where the fluid undergoes a second drop in temperature. The fluid then passes through a conduit 54, and then through the valve 20 in a second direction 56. Some of the fluid liquefies, and that fluid 60 is captured in the left liquid retention chamber 34. The fluid passing through the valve that is not liquefied, as well as boiloff from the liquid 60 in the left container, moves along a conduit 62 through the heat exchanger 30 and the precooler 26 to the left side compressor 16. The left side liquid retention chamber 34 containing liquefied working fluid, is in direct continual thermal contact with the heat load 12, and may also be in close thermal contact with the other chamber 36.

By operating the refrigerator to liquefy at least some of the working fluid in its passage through the Joule Thomson valve, applicant is able to separate out the coldest portion of the expanded working fluid and create a cold reservoir in the liquid. This enables the chambers containing the liquid to remain in continuous thermal contact with the heat load, without the need for any thermal switches between the liquid container and the heat load. By avoiding the need for a heat switch between the coldest portion of the working fluid and the heat load at either side of the valve, applicant avoids the additional complexity and inefficiency that would result from the need to use and operate heat switches at very low temperatures.

Applicant prefers to use sorption compressors 16, 18 which are well known in the prior art. Each adsorption compressor such as 16 includes a quantity of adsorption material such as charcoal which when cold readily adsorbs the working fluid such as helium, and which when hot desorbs the working fluid. To heat the compressor 16 to pump out the working fluid, a first heat switch 70 is closed to couple the adsorption material to a heat source 72'. To adsorb working fluid so as to draw it into the compressor 16, a second heat switch 72 is closed (and the first heat switch, 70, is opened) to thermally couple the adsorption material to a heat sink 74 which is at a temperature lower than the heat source 72'. Sorption compressors can be used with other gas and sorption material combinations, and the system can be used with mechanical compressors.

In order to assure that a substantial amount of the fluid passing through valve 20 will become liquid, the amount of adsorption material in each compressor such as 16 is made great enough, and the amount of working fluid placed in the system is made sufficient, that a high enough pressure drop occurs across the valve 20 to cause liquefaction. A wide variety of other system parameters are also controlled. For example, the temperature of the heat sink 74 is made low enough (by a high temperature refrigerator, not shown) and an appropriate working fluid is chosen which will liquefy at the attained temperature. Also, it is preferable that no substantial expansion of the pressured working fluid flowing out of a compressor, occur until the fluid passes through the valve 20.

In one system that applicant has designed, to maintain the heat load 12 at a temperature of 4° K., the working fluid is helium and the adsorption material in each compressor is charcoal. Sufficient working fluid is contained in the system, so that when the compressor 16 is coupled to the heat source 72' which is at 40° K., the pressure of the fluid reaches 20 atmospheres (300 psi). At the same time, the other compressor 18 can be coupled to the heat sink 74 which is at a temperature of 20° K., with a pressure of working fluid in the right compressor 18 being about 1 atmosphere (15 psi). With the left compressor 16 heated and the fluid at a temperature $T_1$ of 40° K., the fluid passes through the precooler 26 where its temperature at $T_2$ drops to 20° K.. In downward passage through the heat exchanger 30, the fluid temperature drops to a temperature $T_3$ of 10° K.. In passage through the valve 20, the fluid drops to a temperature $T_4$ of 4° K. It requires about one minute for almost all of the pressured fluid to pass through the valve 20. Then the cycle is reversed with the right compressor 18 heated and the left compressor 16 cooled, and it requires another minute for completion of the cycle.

During startup of the refrigerator, the working fluid will normally be at a much higher temperature, such as room temperature (22° C.=295° K.)) which is far above the eventual steady state temperature of the working fluid which may vary between 4° K. and 40° K. in the above example. The density of the working fluid may vary by a ratio of 74 to 1 between 4° K. and 295° K. If the cross-sectional area of the valve is set for efficient operation under steady state conditions, then the area will be too small to allow a large mass flowthrough of fluid at a higher temperature during startup. This results in much less cooling and a much longer time before steady state conditions are achieved. Applicant varies the resistance to flowthrough of fluid of the valve 20, in accordance with the temperature, and therefore density, of the working fluid. When the working fluid has a high temperature, during startup, the resistance is low so that a large volumetric flow of fluid passes through the valve. As the fluid temperature decreases, the resistance increases so there is a smaller volumetric flow through the valve. The change in valve resistance is preferrably made so that fluid passes through the valve at roughly the same mass flow rate, regardless of the temperature of the fluid.

FIG. 2 illustrates details of the valve 20, which includes a tube 80 whose walls 82 can be resiliently compressed to vary the minimum cross-sectional area of the tube passage 84. The valve also includes an anvil or support 86 with a surface 88 that supports one side of the tube, and a compressor element 90 with a compressing surface 92 that can compress the tube. Applicant relies upon the differential coefficient of expansion of materials to move the element 90 towards and away from the support 86 to vary the resistance of fluid passage through the tube.

The support 86 is part of a frame 94 formed of brass which has a thermal coefficient of expansion (TCE) of about $1.2 \times 10^{-5}/°$ C. A screw 96 has an upper end threadably coupled at 98 to a location on the frame spaced from the tube 80, and has a lower end 100 closer to the tube and bearing against the element 90. The screw 96 and element 90 together form a compressing device, which can be constructed as a single item. The screw 96 is constructed of titanium which has a TCE of about $3.6 \times 10^{-6}/°$ C. When the temperature of the valve increases, the distance 102 along much of the length of the brass frame will lengthen, as to the length 104. The orginal length 102 of the screw between the point 98 and the bottom of the screw 100 will not lengthen much. With the point 98 moving up, the bottom of the screw will move down only to the point 106. The net result is that the bottom of the screw will move up to allow the tube 80 to expand. Similarly, when the temperature of the fluid decreases, the parts will contract and the tube will be squeezed progressively more. The element 90 is formed of molybdenum. As also shown in FIG. 3, the tube 80 extends through a hole 110 in the frame, and is in close thermal contact with the frame, so that the temperature of the frame follows the temperature of the tube and the fluid therein.

The screw has a knob 112 that can be turned to determine the initial resistance of the tube at a high temperature, and the system can be tested to determine that the valve is operating efficiently at a steady state. The length of the frame, between the location of ths support surface 88 and the point 98 where it engages the thread, is chosen, in conjunction with the difference in thermal coefficient of expansion of the materials, to achieve the desired reduction in tube cross-sectional area as the working fluid decreases in temperature. In a valve constructed as described above, a tube 80 of 0.032 inch outside diameter of stainless steel was used with a frame 94 of overall height of 0.5 inch, and was found to effectively vary the flow rate.

It should be noted that the change in flow resistance of the valve does not depend directly upon the temperature of the heat load 12, which may require some time to achieve its steady state temperature after the working fluid has reached its steady state low temperature. Instead, the valve resistance is adjusted in accordance with the temperature of the working fluid passing through the valve, to maintain a substantially constant (less than 7 to 1 variation) mass flow of fluid through the valve during startup when the temperature of the fluid drops greatly, as from room temperature to near absolute zero. The use of a squeezable tube to vary the valve resistance avoids the difficulty of sealing moving parts against the loss of fluid. It would be possible to use a temperature sensor that senses fluid temperature anywhere in the system, or a timer circuit which begins counting when system startup begins, to control a motor that varies valve resistance. However, reliance on differential TCE's can result in a simpler system, and one which is self-actuated.

Thus, the invention provides a Joule Thomson refrigerator which is especially efficient at the cold end of the refrigerator. In a bi-directional refrigerator, the working fluid undergoes a sufficient pressure drop, starting at a sufficiently low temperature, that much of the fluid becomes liquid. The liquid is captured in a liquid-holding container at each side of the valve, with each container in direct and continuous thermal contact with the heat load. The resistance to fluid passage through the valve is varied according to the temperature of the working fluid, to maintain a more constant mass flow rate of fluid through the valve despite variation in working fluid temperature during startup of the refrigerator, than if the valve passage had a constant cross-sectional size.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A bi-directional refrigeration system for cooling a heat load comprising:

first and second compressors;

first and second liquid containers;

a Joule-Thomson gas expansion valve having first and second opposite sides;

a first conduit extending between said first compressor and said first side of said valve, and a second conduit extending between said second side of said valve and said second compressor, each container coupled to one of said conduits at a different side of said valve to receive liquid resulting from gas expanding through said valve;

each container being in continual thermal contact with said heat load.

2. The system described in claim 1 wherein:

said liquid containers are thermally coupled to each other so they are always at substantially the same temperature.

3. The system described in claim 1 wherein:

said valve is adjustable to change the resistance to the flow of gas therethrough; and including a working fluid lying in said conduit and containers; and means responsive to the temperature of said working fluid for adjusting said valve to increase the resistance to flow therethrough as the temperature of said fluid near said valve decreases.

4. A method for cooling a heat load comprising:

pumping a gaseous working fluid from a first compressor means in a first direction, through a Joule-Thomson valve from a first side to a second side of said valve, wherein the fluid temperature and pressure drop across said valve results in condensation into liquid on said second valve side of at least some of said fluid passing in said first direction;

catching said liquid in a container from said second valve side, wherein said container is in continual thermal contact with said heat load;

flowing gaseous working fluid from said second side of said valve to a second compressor means;

compressing working fluid in said second compressor means and precooling said compressed working fluid and passing said compressed and precooled working fluid in a second direction opposite to said first direction through said valve to condense into liquid on said first valve side at least some of said fluid passing in said second direction;

catching said liquid passing in said second direction in a container from said first valve side, wherein said container is in constant thermal contact with said heat load;

flowing gaseous working fluid from said first side of said valve to said first compressor means; and cyclically repeating said steps of pumping fluid in a first direction, catching liquid from said second side, conducting fluid to said second compressor, compressing fluid and passing it in said second direction, catching liquid from said first side, and conducting fluid to said first compressor.

5. The method described in claim 4 including:

sensing the temperature of said working fluid at a predetermined location, and altering the resistance to fluid passage through said valve to increase the resistance as the fluid becomes colder, whereby to effectively operate during startup when the working fluid is warm, as well as during continuing operation when the working fluid temperature has dropped.

* * * * *